US006352660B1

(12) United States Patent
Friedrich et al.

(10) Patent No.: US 6,352,660 B1
(45) Date of Patent: Mar. 5, 2002

(54) PREPARATION OF COMPOSITE FIBERS AND DIAPHRAGMS

(75) Inventors: Holger Friedrich, Bobenheim-Roxheim; Ulrich Bröckel, Freinsheim; Dieter Schläfer, Ludwigshafen; Klaus-Dieter Hoppe, Wachenhiem; Kurt Hecky, Zeiskam; Peter Palm, Gerolsheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/176,151

(22) Filed: Oct. 21, 1998

(30) Foreign Application Priority Data

Oct. 21, 1997 (DE) ..... 197 46 404

(51) Int. Cl.[7] ..... B29G 1/26

(52) U.S. Cl. ..... 264/102; 264/127; 264/5; 264/8; 264/9; 162/146; 162/157.5; 428/364; 428/421; 428/422

(58) Field of Search ..... 162/181.1, 181.6, 162/181.7, 146, 157.5; 264/102, 5, 8, 9, 127; 428/364, 421, 422, 370, 373, 374, 357, 368

(56) References Cited

U.S. PATENT DOCUMENTS

| | | | | | |
|---|---|---|---|---|---|
| 4,219,512 | A | | 8/1980 | Sinn et al. | 264/22 |
| 4,337,140 | A | * | 6/1982 | Solomon | 204/292 |
| 4,680,101 | A | | 7/1987 | Darlington et al. | 204/295 |
| 5,192,473 | A | * | 3/1993 | Hrsuka et al. | 264/102 |
| 5,700,572 | A | * | 12/1997 | Klatt et al. | 428/357 |
| 5,919,348 | A | * | 7/1999 | Friedrich et al. | 205/350 |

FOREIGN PATENT DOCUMENTS

| | | |
|---|---|---|
| DE | 2646332 | 4/1978 |
| EP | 048617 | 3/1982 |
| EP | 196 317 | 10/1986 |
| WO | 86/01841 | 3/1986 |

* cited by examiner

*Primary Examiner*—Peter Chin
*Assistant Examiner*—M. Halpern
(74) *Attorney, Agent, or Firm*—Keil & Weinkauf

(57) ABSTRACT

Composite fibers useful for preparing diaphragms are prepared by (a) mixing a PTFE or PTFE copolymer dispersion or powder with a finely divided inorganic material and a fiber forming material, (b) shear heating the resulting mixture to a temperature at which sheared to PTFE or PTFE copolymer becomes flowable without showing signs of decomposition while removing the dispersion medium, if a PTFE or PTFE copolymer dispersion is used, (c) cooling the mixture to below 70° C., (d) mix shearing the mixture at below 70° C. to form composite fibers.

9 Claims, No Drawings

PREPARATION OF COMPOSITE FIBERS AND DIAPHRAGMS

The present invention relates to a process for preparing composite fibers and diaphragms as used, for example, in chlor-alkali electrolysis.

There are basically two types of chlor-alkali electrolytic cells for the production of caustic soda and chlorine from sodium chloride: mercury and diaphragm. In the diaphragm process, a porous diaphragm separates the anode and cathode compartment. An aqueous sodium chloride solution flows from the anode compartment through the diaphragm into the cathode compartment, where hydrogen is produced at a steel cathode. The effluent cell liquor comprises sodium hydroxide as well as sodium chloride. The chlorine produced at the anode is obtained in gaseous form. Modern diaphragm cells feature adjustable, activated titanium anodes and increasingly diaphragms densified with synthetic polymer fibers instead of the traditional asbestos diaphragms.

Diaphragms are formed of a basic structure of organic polymer fibers which holds inorganic materials. Various processes for preparing such diaphragms or for preparing the composite materials used for preparing the diaphragms are known.

U.S. Pat. No. 4,680,101 describes a process for preparing diaphragms by mixing a dispersion of polytetrafluoroethylene (PTFE) fibrils, polypropylene fibers and a perfluorinated ion exchange material in water and applying the slurry to a perforated steel plate cathode covered with a cellulose filter paper. After removal of the volatiles, the diaphragm is dried at from 120° C. to 130° C. and, after cooling, impregnated with a solution of partially hydrolyzed silicon alkoxide and zirconium alkoxide. Then the diaphragm is dried again.

EP-B-0 196 317 describes a process for preparing fiber composite materials by using a ball mill to hot mix a PTFE dispersion with zirconium dioxide and sodium chloride, which initially causes the dispersion medium to escape. After the mixing, the product obtained is separated from the ball media used. It comprises irregularly shaped, partly branched fibers consisting of a composite of the PTFE used and the finely divided zirconium dioxide. The second inorganic material, sodium chloride, assists in the fiber formation process and can be dissolved out by the brine before or during the subsequent application. The fibers obtained can then be used to prepare a diaphragm. Prior art diaphragms do not always exhibit the desired high flow resistance, which prevents backmixing of the caustic obtained during the electrolysis. The diaphragms obtained are accordingly not of sufficient quality for all applications.

Not all the above-described process variants are suitable for preparing fibers for chlor-alkali electrolysis diaphragms. Not just any branched fiber can be used for preparing chlor-alkali electrolysis diaphragms. The diaphragms obtained from the fiber do not always have the required defined flow resistance.

The flow resistance of a diaphragm determines the rate of flow of the brine through the diaphragm. The flow rate also depends on the pressure forcing the brine through the diaphragm. In the field, the pressure is regulated by the difference in head between the brine feed and the catholyte effluent. Suitable values range, for example, from 20 to 70 cm of liquid column. This flow rate in turn has a direct bearing on the concentration of the caustic produced. In addition, the applied current density has no influence on the optimal flow rate. The concentration of caustic obtained should range from 100 to 150 g/L. In the field, this requires flow rates of 20–30 $L/m^2h$ and current densities from 2 to 2.5 $kA/m^2$, for example.

The use of a ball mill for preparing the fibers leads to problems due to incomplete removal of the water in the dispersion. Said incomplete removal of water can cause rusting of the steel balls used, in which case PTFE will collect on the rust-roughened surfaces of the steel balls, preventing adequate fiber formation. To circumvent this problem, the starting materials have to be mixed and dried in another apparatus. This makes the process costly. In addition, at the end of the ball milling step, the balls used have to be separated off to isolate the fibers. This separation step is costly. It can take the form of sieving, for example.

It is an object of the present invention to provide a process for preparing such composite fibers as permit the preparation of diaphragms having a defined flow resistance to meet the technical requirements of a chlor-alkali electrolysis cell.

We have found that this object is achieved according to the invention by the process for preparing composite fibers by (a) mixing a PTFE or PTFE copolymer dispersion or powder with a finely divided inorganic material and a fiber forming material, (b) shear heating the resulting mixture to a temperature at which sheared PTFE or PTFE copolymer becomes flowable without showing signs of de-composition while removing the dispersion medium, if a PTFE or PTFE copolymer dispersion is used, (c) cooling the mixture to below 70° C., (d) mix shearing the mixture at below 70° C. to form the composite fibers.

The invention proposes that shearing the mixture of PTFE or PTFE copolymer, finely divided inorganic material and fiber forming material especially at less than 70° C. provides fibers which permit the preparation of improved diaphragms having a defined flow resistance.

The heating in step (b) is preferably to more than 70° C., particularly preferably to more than 100° C., especially 130–180° C. Thereby coarse clumpy fiber hanks are formed. The cooling in step (c) and the shearing in step (d) are each preferably carried out at 20–60° C. A lower temperature in step (d) makes the mixing and shearing more difficult because of the increased stiffness of the material. In this step a chopping of the material and a separation into free flowing fibers is performed.

The invention further proposes that the shearing of the mixture in step (d) is advantageously carried out in mixers at a Froude number of more than 1. This requires the use in this step of mixers having a Froude number of more than 1. In this case the cooling in steps (c) and (d), respectively, is not necessary.

The Froude number is a measure of the intensity of mixing and is defined as $Fr=r^2/g$ where =2 .f, f=fre-quency, r=radius, g=gravitational constant. The frequency is determined from the speed of the mixing tool. The radius is the largest distance between the mixing tool and the shaft.

Examples of suitable mixers are Eirich mixers, ring tub mixers, ring layer mixers, DRAIS mixers. It is similarly possible to use a Lödige mixer fitted with additional choppers whereby Froude numbers of more than 1 can be achieved. A particularly preferred high intensity mixer is an Eirich mixer which is characterized in that it has a rotating mixing pan and a mixing tool rotor which selectively rotates or contrarotates. The mixing tool can reach a very high speed of more than 2000 rpm. The mixing tools are whisk- or stirrerlike tools which can have diverse geometric shapes and which ensure thorough mixing and an input of a high level of mixing energy. A wall scraper prevents material sticking to the walls. Eirich high intensity mixers are available from Maschinenfabrik Gustav Eirich, Hardheim, Germany.

The process can preferably be carried out in a vacuum mixer which can be heated. Vacuum mixers are provided by Eirich. These mixers perform the so-called EVACTHERM® process (of Eirich).

The heating of these mixers is performed by steam or hot steam which is led directly onto the mixture, and by the heating jacket of the mixer. The temperature of the jacket which is heated with steam as well may be adjusted by applying pressure or lower pressure. This specific advantage of these mixers is the possibility to rapidly cool the content. By injecting water and subsequently evacuating the mixer content may be cooled to the desired temperature (less than 70° C.). The invention relates also to the use of these types of mixers with a Froude number of more than 1 in the production of composite fibers.

Customary mixers, such as Brabender mixers, Banbury mixers and Houbart mixers or ball mills, cannot attain a Froude number of more than 1. Ball mills, in particular, additionally have the disadvantages mentioned in the introduction.

The process of the invention provides fibers which are dry and free flowing. This is achieved especially by using the high intensity mixer in step (d). The aforementioned high intensity mixers are also used with particular preference in step (b) of the process of the invention. More particularly, all steps of the process of the invention are carried out in one and the same high intensity mixer, so that there is no need for any transfer during the process. The resulting fibers, which are dry and free flowing, are simple to remove from the mixer. In contrast to ball mills, moreover, the costly removal of the balls from the fibers is obviated. The multistep nature of the process, especially drying and fiber formation at high temperatures and fiber comminution at lower temperatures, permits control of the properties of the fibers in a specific manner, making it possible to set the flow resistance of the diaphragms prepared therefrom.

The PTFE or PTFE copolymer dispersion used in step (a) is preferably an aqueous dispersion. Following mixing with the finely divided inorganic material and the fiber forming material, step (b) comprises removing the dispersion medium, preferably water, by heating and commencing fiber formation by shearing. Following the cooling of the mixture in step (c), step (d) comprises finishing the fibers by comminution to obtain the free flowing fiber material of the invention.

The fiber forming material used is preferably an alkali metal salt or an alkaline earth metal salt. It is preferably an alkali metal halide or an alkaline earth metal halide. Particular preference is given to sodium chloride, magnesium chloride, calcium chloride or else sodium carbonate, with sodium chloride being used in particular. The particle size is preferably less than 300 $\mu$m, more preferably less than 200 $\mu$m, particularly preferably less than 100 $\mu$m, for 90% by weight of the particles. A typical preferred particle size distribution is as follows: 10%<5 $\mu$m, 50%<40 $\mu$m, 90%<80 $\mu$m.

The finely divided inorganic material used can be an inorganic material which is chemically stable under the conditions of chlor-alkali electrolysis. It must be stable to strong alkalis, acids and oxidizing media, such as chlorine. Finely divided inorganic material used is preferably an oxide, carbide, boride, silicide, sulfide, nitride or silicate such as $ZrSiO_4$ or an alumosilicate or aluminate, except asbestos, especially a transition metal oxide. The material should be stable in acidic and alkaline aqueous media. The use of zirconium oxide is particularly preferred. The average particle size of the finely divided inorganic material is preferably less than 100 $\mu$m, particularly preferably less than 40 $\mu$m, especially less than 10 $\mu$m. A preferred particle size distribution is as follows:

10%<0.5 $\mu$m

50%<1.2 $\mu$m

90%<5.7 $\mu$m

A further preferred distribution is as follows:

10%<0.63 $\mu$m

50%<1.74 $\mu$m

90%<10.18 $\mu$m

The PTFE or PTFE copolymer dispersion is prepared by dispersing PTFE or PTFE copolymer, preferably in water, in the presence of a dispersant, especially of a nonionic surfactant in an amount of 1–10% by weight, based on the PTFE or PTFE copolymer.

Preferred dispersions are prepared by emulsion polymerization. The solids content is preferably from 30 to 80%, particularly preferably from 50 to 70%. The viscosity of the dispersion is preferably from 7 to 13 mPas at a shear rate of 4000/s. The particle size is preferably within the range from 100 to 500 nm, particularly preferably within the range from 150 to 300 nm.

Preferred dispersions have the following properties:

| | | | | | | |
|---|---|---|---|---|---|---|
| Solids content | % | ASTM D 4441 | 60 | 35 | 58 | 55 |
| Emulsifier | | | non-ionic | ionic | non-ionic | non-ionic |
| Emulsifier quantity based on solids | % | ASTM D 4441 | 5 | 4 | 5 | 10 |
| pH | — | ASTM D 4441 | 8.5 | 10 | 8.5 | 8.5 |
| Viscosity | mPa · s | DIN 54 453 D = 4000 $s^{-1}$ | 9 | 3 | 10 | 15 |
| Density | g/cm$^3$ | Areometer | 1.5 | 1.25 | 1.5 | 1.4 |
| Average particle size | nm | Laser method | 180 | 180 | 250 | 250 |

PTFE or PTFE copolymer powders useful for the invention preferably have bulk densities within the range from 300 to 1000 kg/m$^3$, particularly preferably within the range from 400 to 600 kg/m$^3$. The average particle size is preferably within the range from 20 to 1000 $\mu$m, particularly preferably within the range from 250 to 700 $\mu$m. The powders are preferably free flowing, especially powders having an average particle diameter of about 500 $\mu$m and a bulk density of about 500 kg/m$^3$. The PTFE or PTFE copolymer powders can be dispersed in a dispersion medium before use.

It may be advantageous in some instances that the solids content of the PTFE dispersion employed is reduced by adding water in order to obtain a desired concentration. A prediction of the necessary water amounts is not possible. The amount needs to be adapted in each single case (for example 2 to 30%, more specific 5 to 10% when using a 60% dispersion.

The PTFE or PTFE copolymer powders can also be used without being first dispersed in a dispersion medium. This has the advantage that no dispersion medium has to be removed. However, it is nonetheless preferable to add to the powders a surfactant in an amount of 1–15%, based on the PTFE weight. The surfactant can be added before, during or after the mixing of the components in step (a), but in any event before the heating [step (b)]. Surfactants used are preferably nonionic surfactants. Preferably they are compounds based on oxo alcohols or fatty alcohols having 10–18 carbon atoms, alkylphenols, fatty acids or fatty acid amides, which all contain polyethylene oxide radicals having 3–20 ethylene oxide units, or they are surfactants based on oleic acid alkoxylate, fatty alcohol alkoxylate, fatty acid alkoxylate or alkylphenol alkoxylate. Particular preference is given to using surfactants based on alkylphenols with polyethylene oxide radicals containing from 6 to 20 ethylene oxide units (e.g., Lutensol® AP6 from BASF).

Modified PTFE types may be employed as the PTFE. The modified PTFE contains small amounts of appropriate comonomers. Appropriate comonomers are e.g. hexafluorpropylene, perfluor(propylvinylether), ethylene, chlortrifluorethylene, venylidenfluoride. Preferably perfluorinated comonomers are employed. Modified PTFE powders may be obtained from Dyneon under the brand Hostaflon® TFM. They contain less than 1% of a comonomer.

PTFE copolymers may contain larger amounts of comonomers, for example 7 to 8 mol.-%. Among the preferred comonomers hexafluoropropylene (FEP) and perfluoro(propylvinylether) (PFA) the comonomers disclosed in U.S. Pat. No. 5,192,473 may be employed.

The weight ratio of PTFE or PTFE copolymer to finely divided inorganic material, without fiber forming material, is preferably within the range from 0.2 to 0.6, particularly preferably within the range from 0.25 to 0.5, especially within the range from 0.28 to 0.43.

The following is a description of the preferred embodiment of the invention:

The finely divided inorganic material and the fiber forming material are introduced into the Eirich mixer and briefly mixed through. The cylinder of the mixer is then set rotating, the rotor is switched on and then the PTFE or PTFE copolymer dispersion is added. It is possible to add the components in any desired order. Whatever the order of addition, the rotor should be on, to effect thorough mixing.

The rotor is then switched off or adjusted to an appropriate level, e.g. 450 Upm, and the mixing pan is allowed to rotate at low speeds of preferably not more than 100 rpm while the mixture is heated to the desired temperature. The temperature range for fiber formation depends on the material used. In general, the temperature is more than 70° C., for example within the range from 80 to 200° C. The water present in the dispersion is removed in this step, so that it should be carried out at temperatures below 100° C. and reduced pressure. Reduced pressure can also be employed at higher temperatures in order that the removal of the water and, where appropriate, the dispersant may be speeded up.

The heating preferably takes from 0.25 to 2 hours. The heating time depends on the design and size of the mixer and on the type of heating and can also be more than 2 hours in the case of lower heating power. In the field, values of up to 6 hours are uncritical. Heating can be effected, for example, via wall heating or by introduction of high temperature steam (superheated steam).

Once the desired temperature is reached, fiber formation will generally be substantially complete. Mixing may continue at that temperature for a further 5–240 min.

The mixer contents are then allowed to cool down again. This is most simply done by allowing the contents to stand, i.e., without further mixing. However, during cooling, mixing may also be continued or a coolant such as cold air blown in or water blown in and subsequently evacuated for faster cooling.

Once the temperature is below 70° C., preferably within the range from 20 to 60° C., the rotor is switched on to comminute the clumped fiber material. The rotor is preferably set to a speed within the range from 300 to 2500 rpm. The mixing time is preferably within the range from 10 sec to 60 min. The mixing speed and the mixing time depend on the desired degree of comminution. In general, mixing times from 1 to 1.5 min are sufficient at a speed of 2500 rpm and from 1 to 5 min at a speed of 450 rpm.

Thereafter the free falling fiber material can be discharged in a simple manner.

The composite fibers obtained constitute a dry, free flowing, finely divided material. The fibers are fibrillike, anisotropic and of irregular morphology. The color depends on the inorganic material used and the PTFE polymer or copolymer. Each individual fiber can be branched or unbranched. Inorganic material is uniformly dispersed within the entire fiber and intimately mixed with the PTFE or PTFE copolymer as polymeric binder, so that it cannot be removed without destruction of the fiber. In addition, there is finely divided inorganic material on the surface of the fiber.

The composite fibers preparable or prepared according to the invention are useful for preparing diaphragms, especially chlor-alkali electrolysis diaphragms.

The invention also provides the process for producing diaphragms by (A) preparing composite fibers by one of the aforementioned processes, (B) introducing the composite fibers into a solution comprising water and a thickener for increasing the viscosity, (C) suction filtering the mixture from (B) through a porous base to deposit the composite fibers on the porous base, (D) drying the coated porous base from (C), (E) thermally treating the diaphragm from (D) at from 90 to 390° C.

The diaphragms can be prepared as described in EP-B 0 196317. The porous base used can be, for example, a cathode which is in the form of a grid and covered with a polyamide network.

The Examples which follow illustrate the invention.

EXAMPLE 1

0.9 kg of $ZrO_2$ of the following particle size:

10%<0.5 μm

50%<1.2 μm

90%<5.7 μm and 1.58 kg of sodium chloride of the particle size

10%<5 μm

50%<40 μm

90%<80 μm are introduced into a 5 L Eirich mixer (Eirich R02) and mixed through for 2 min by rotating the pan at 84 rpm and corotating the rotor at 450 rpm. A Froude number of about 20 is reached in the process. 0.66 kg of an approximately 60% strength PTFE dispersion (Hostaflon® TF 5050 from Dyneon) is then added via a nozzle over 3 min with continued mixing and additionally mixed in for 2 min. Thereafter the speed of the pan is reduced to 42 rpm, the rotor continues at 450 rpm, and the contents are heated to 160° C. (duration about 60 min) to form highly entangled and clumped fiber coils. Thereafter the mixing tools are switched off and the contents are allowed to cool down to 40° C. At this temperature, the rotor (450 rpm) and the pan (42 rpm) are switched back on and the contents are mixed for 2 min to reduce the fibers to the desired size. Free flowing $ZrO_2$/PTFE composite fibers of irregular morphology are obtained.

COMPARATIVE EXAMPLE C2

0.9 kg of $ZrO_2$ of the following particle size:

10%<0.5 μm

50%<1.2 μm

90%<5.7 μm and 1.58 kg of sodium chloride of the particle size

10%<5 μm

50%<40 μm

90%<80 μm are introduced into a 5 L Eirich mixer (Eirich R02) and mixed through for 2 min by rotating the pan at 84 rpm and rotating the rotor at 450 rpm. 0.66 kg of an approximately 60% strength PTFE dispersion (Hostaflon® TF 5050 from Dyneon) is then added via a nozzle over 3 min with continued mixing and additionally mixed in for 2 min. Thereafter the speed of the pan is reduced to 42 rpm, the rotor is switched off, and the contents are heated to 160° C. (duration about 90 min) to form highly entangled and clumped fiber coils. Thereafter the rotor is switched on with a speed of 2500 rpm to comminute the clumps at 160° C. A fibrous product is obtained. Comminution at 450 rpm and 160° C. was not successful. The diaphragms prepared from the fibers give a much too high flow rate (see Example 4).

EXAMPLE 3

0.9 kg of $ZrO_2$ of the following particle size:

10%<0.5 μm

50%<1.2 μm

90%<5.7 μm and 1.58 kg of sodium chloride of the particle size<315

20%<63 μm

70%<63–200 μm

90%<200 m are introduced into a 5 L Eirich mixer (Eirich R02) and mixed through for 2 min by rotating the pan at 84 rpm and contrarotating the rotor at 450 rpm. 0.66 kg of an approximately 60% strength PTFE dispersion (Hostaflon® TF 5050 from Dyneon) is then added via a nozzle over 3 min with continued mixing and additionally mixed in for 2 min. Thereafter the speed of the pan is reduced to 42 rpm, the rotor continues at 450 rpm, and the contents are heated to 130° C. (duration about 45 min) to form highly entangled and clumped fiber coils. Thereafter the mixing tools are switched off and the contents are allowed to cool down to 20° C. At this temperature, the rotor (450 rpm) and the pan (42 rpm) are switched back on and the contents are mixed for 2 min to reduce the fibers to the desired size. Free flowing $ZrO_2$/PTFE composite fibers of irregular morphology are obtained.

EXAMPLE 4

Preparation of Test Diaphragms and Measurement of Flow Rate

Preparation of Slurry Liquor 12.5 kg of demineralized (DM) water+50% strength NaOH to set a pH of about 11 and 26.25 g of the thickener Welan Gums from Oxytech are homogenized. Then 26.25 g of Proxel® GXL (biocide based on 1,2-benzisothiazolin-3-one) and 3.1 g of silicone defoamer DC 10010 A are added.

Preparation of Fiber Slurry

The fiber slurry is reckoned for a test diaphragm 75 $cm^2$ in area (d=9.8 cm).

434 g of slurry liquor 62.5 g of fibers

The weighed-out components are stirred with a magnetic stirrer at 900–1000 1/min for 15 min.

Deposition of a Test Diaphragm

An original U.S. cathode screen covered with a fine mesh nylon network is placed in a small deposition apparatus. Thereafter the homogenized fiber slurry is poured on and allowed to pass through the nylon network for 30 min without reduced pressure. The amount of slurry liquor which passes through is 170–210 mL. The pressure of the deposition apparatus is then reduced by means of a membrane

| Time in min | 0 | 1 | 5 | 9 | 17 | 20 | 25 | 30 | 40–140 |
|---|---|---|---|---|---|---|---|---|---|
| Pressure in Bar | 1013 | 980 | 940 | 850 | 740 | 630 | 530 | 500 | 500 |

After 55 min the supernatant fiber slurry is decanted off, and the diaphragm is suction filtered for a further 90 min. After 140 min the pump is switched off and the diaphragm is removed.

Thermal Aftertreatment drying of deposited diaphragm at 95° C. for 6 h heating from 95° C. to 320° C. over about 1.5 h temperature of 320° C. maintained for 1.5 h temperature raised from 320° C. over 1 h 360° C. maintained for 1.5 h cooling back to room temperature in closed switched off oven.

Hydrophilicization

In a glass beaker, the diaphragm is treated with 4% strength solution of Zonyl FSN® (fluoro surfactant from DuPont) for ½ h and then dried at 70–80° C. for 12 h.

Flow Rate Measurement

The experimental diaphragms are subjected to a flow rate measurement with brine solution (300 g/L of NaCl) at room temperature and a constant head of 22 cm.

Result of Flow Rate Measurement

Target values range from 5 to 40, preferably 10 to 30, $L/m^2h$.

| Diaphragms from fibers of Example | Flow rate $L/m^2h$ |
|---|---|
| 1 | 11 |
| C2 | 150 |
| 3 | 27 |

EXAMPLE 5a–e

Effect of Time on Filtration Resistance 0.9 kg of $ZrO_2$ of the following particle size:

10%<0.5 μm

50%<1.2 μm

90%<5.7 μm and 1.58 kg of sodium chloride of the particle size

10%<5 μm

50%<40 μm

90%<80 μm are introduced into a 5 L Eirich mixer (Eirich R02) and mixed through for 2 min by rotating the pan at 84 rpm and rotating the rotor at 450 rpm. 0.66 kg of a 60% strength PTFE dispersion (Hostaflon® TF 5050 from Dyneon) is then added via a nozzle over 3 min with continued mixing and additionally mixed in for 2 min. Thereafter, the rotor is switched off, the pan is allowed to rotate at 42 rpm, and the contents are heated to 130° C. (duration about 45 min) to form highly entangled and clumped fiber coils and the system is then cooled down to about 20° C. Thereafter the rotor is switched on and allowed to rotate at 450 rpm for 30–90 sec to form free flowing irregularly shaped composite fibers.

50 g lots of the fibers prepared in this way are slurried up in 500 ml of water and filtered through a frit under a pressure of 100 mbar to form a filter cake 14 mm in thickness. The time for 490 mL of water to pass through is determined each time. It is a measure of the filtration resistance or the flowthrough resistance of the filter cake. The results show that the flowthrough resistance of the filter cake produced from the fibers depends on the comminution time in the mixer. The longer the comminution time, the denser the filter cakes which can be obtained from the fibers produced.

| Specimen | Time Seconds | Flowthrough time Sec |
|---|---|---|
| A | 30 | 101 |
| B | 45 | 128 |
| C | 60 | 154 |
| D | 75 | 175 |
| E | 90 | 190 |

EXAMPLE 6

The process of Example 1 was repeated, except that mixing at room temperature for 10 min was followed by heating over 60 min to 92° C. without the rotor having been switched on. The rotor was then switched on and run at 450 rpm for 10 min with heating to 109° C. The rotor is not switched off in the subsequent steps, but continues to rotate at a speed of 150 rpm. On attainment of a temperature of 109° C., the batch is cooled down to 40° C. and then heated up once more, over 15 min, to 160° C. It is then cooled down to 62° C. and comminuted.

The fibers obtained can be used to obtain effective diaphragms. It is possible to reprocess, by renewed heating, fibers which have become too small through overlong comminution. Fiber formation recommences in the course of the heat treatment, so that useful fibers can be obtained.

EXAMPLE 7

0.9 kg $ZrO_2$ of the particle size given in Example 1 and 1,58 kg NaCl of a medium particle size (D50) of 13 m are added to an Eirich mixer (R02) and mixed with a rotor speed of approximately 1500 Upm. 660 g of 60% PTFE dispersion are diluted with 50 1 water and added to the $ZrO_2$/NaCl mixture through a nozzle under continued mixing. The mixing is continued for additional 5 minutes, thereby the mixture is granulated. Subsequently the speed of the rotor is reduced to 450 Upm. The rotation is in the same sense. The mixture is rotated with 42 Upm. The content is then heated to approximately 160° C., whereby strongly tangled and lumpy fiber balls are formed. After cooling the mixture content to 50 to 60° C. mixing is continued for 4 to 5 minutes with a speed of 450 Upm, thereby further chopping and separating the fibers.

Afterwards a fiber slurry is produced using 1736 g of the solution of Example 4 and 250 g of fibers. In this fiber suspension an apparatus is inserted which contains a round piece of cathode grating. The surface area is 78.5 $cm^2$. By employing vacuum at the backside of the cathode screen the dispersed fibers are sucked to the screen until no further fibers are sucked on. After taking off the diaphragm of the fiber bath the vacuum is continued with a pressure of 50 to 150 mbar.

After drying and thermal treatment of the diaphragms according to Example 4 the diaphragm had a weight of 35 g. This corresponds to a sheet weight of approximately 4.5 $kg/m^2$. Afterwards the diaphragm was hydrophilized with 4% zonyl solution for 24 hours. During the subsequent measurement of the flowthrough a flowthrough speed of 20 to 25 $1/hm^2$ was found.

An electrolytic cell for the chlorine alkali electrolysis with an electrode surface of 7 $dm^2$ was equipped with fibers coming from several identical productions in an analogous manner employing a diaphragm of 7 $dm^2$. As described above a box type deposition apparatus with the cathode screen (7 $dm^2$) was inserted in the respective fiber bath (containing 43,4 kg fiber slurry according to Example 4 and 6,5 kg fibers). It was sucked onto the backside of the cathode screen of the diaphragm by employing vacuum. After finishing the sucking process the cathode construction coated with a diaphragm was dried and thermally treated according to Example 4. After sintering and hydrophilizing the diaphragms the electrolytic cell was assembled and operated for five weeks with the following parameters:

In-flow of Brine:

Concentration: approx. 300 g/l Na Cl

Amount: 2,2 1/h

Temperature: 80° C.

Head: 250 to 350 nm

Obtained Cell Base Solution:

Concentration: 120 g/l

Through-flow speed: 1.8 to 2,0 1/h

Chlorate concentration: 30 to 50 ppm

Chlorine Prepared:

>97 Vol.%

Hydrogen: <0.7%

Oxygen: <2.2%

Nitrogen: <0.1%

Cell voltage: 3.25 to 3.35 V

Current density: 2.2 to 2.3 $kA/m^2$

We claim:

1. A process for preparing composite fibers which process comprises (a) mixing a PTFE (polytetrafluoroethylene) or a PTFE copolymer dispersion in a dispersion medium or powder with a finely divided inorganic material and a fiber forming material to form a mixture, (b) shear heating the resulting mixture to a temperature at which sheared PTFE or PTFE copolymer becomes flowable without showing signs of decomposition while, if a dispersion medium is present, removing that dispersion medium, (c) cooling the mixture to below 70° C., and (d) mix shearing the mixture at below 70° C. to form composite fibers.

2. The process of claim 1, wherein said fiber-forming material used is an alkali metal salt or an alkaline earth metal salt.

3. The process of claim 1, wherein said finely divided inorganic material used is $ZrO_2$.

4. The process of claim 1, wherein the weight ratio of said PTFE or said PTFE copolymer to said finely divided material is within the range from 0.2 to 0.6.

5. The process of claim 1, wherein step (d) is carried out in a mixer having a Froude number of more than 1.

6. The process of claim 1, wherein steps (a) to (b) are carried out in a single apparatus.

7. The process of claim 1, wherein step (b) is carried out at reduced pressure.

8. The process of claim 1, wherein the heating in step (b) is to above 70° C.

9. A process for preparing composite fibers, which process comprises (a) mixing a PTFE (polytetrafluoroethylene) dispersion in a dispersion medium or powder with a finely divided inorganic material and a fiber forming material, (b) shear heating the resulting mixture to a temperature at which sheared PTFE becomes flowable without showing signs of decomposition while, if a dispersion medium is present, removing that dispersion medium, and (c) mix shearing the mixture with a mixer having a Froude number of more than 1 to form composite fibers.

* * * * *